United States Patent [19]

Torii et al.

[11] 4,398,837

[45] Aug. 16, 1983

[54] PRINTING APPARATUS AND METHOD FOR PREVENTING PRINTING ERRORS IN SAME

[75] Inventors: Hiroshi Torii; Masaharu Mori, both of Nagoya, Japan

[73] Assignee: Brother Kogyo Kabushiki Kaisha, Nagoya, Japan

[21] Appl. No.: 361,063

[22] Filed: Mar. 23, 1982

[30] Foreign Application Priority Data

Mar. 31, 1981 [JP] Japan ..... 56-47751

[51] Int. Cl.[3] ..... B41J 1/30; B41J 7/96

[52] U.S. Cl. ..... 400/74; 318/565; 400/54; 400/144.2

[58] Field of Search ..... 400/54, 74, 144.2; 318/565, 632, 696

[56] References Cited

U.S. PATENT DOCUMENTS

| | | | |
|---|---|---|---|
| 4,143,980 | 3/1979 | Giebler et al. | 318/696 X |
| 4,178,108 | 12/1979 | Kane | 400/74 X |
| 4,279,523 | 7/1981 | Ringle | 400/54 X |
| 4,291,620 | 9/1981 | Yamasaki et al. | 400/74 X |

FOREIGN PATENT DOCUMENTS

| | | | |
|---|---|---|---|
| 55-84687 | 6/1980 | Japan | 400/144.2 |
| 55-101488 | 8/1980 | Japan | 400/54 |
| 55-161681 | 12/1980 | Japan | 400/54 |

*Primary Examiner*—Paul T. Sewell

*Attorney, Agent, or Firm*—Browdy & Neimark

[57] ABSTRACT

A printing apparatus comprising a print wheel having a multiplicity type elements, and a detecting unit for detecting angular positions of the print wheel including its fixed home position. The apparatus further comprises a control unit which includes a first counter which stores data representative of an angular distance of a type element currently located at the printing position as measured from the home position, and a second counter which stores data representative of an angular position of a type element designated by a print signal. Both counters are operated as they receive position signals from the detecting unit. The control unit is so arranged that in the event of an unexpected rotation of a wheel driving rotary shaft which is not a result of the actuation of a wheel driving motor in response to the print signal, the print wheel is first reset to the home position before it is rotated to bring a designated type element to the printing position, whereby chances for printing errors due to such unexpected rotation are eliminated. A method for controlling to prevent the printing errors is also disclosed.

14 Claims, 3 Drawing Figures

PRINTING APPARATUS AND METHOD FOR PREVENTING PRINTING ERRORS IN SAME

BACKGROUND OF THE INVENTION

The present invention relates generally to improvements in a printing apparatus, and more particularly to a printing error preventive system and process in a printing apparatus equipped with a print wheel having a multiplicity of circumferentially spaced type elements.

In recent years, printing instruments such as electronically-controlled typewriters have been increasingly employing a printing apparatus of the type in which a print wheel is rotatably operated by a driving motor in response to printing signals and its changing angular position is detected by a detecting unit so as to bring a desired or selected type element to a fixed printing position at which the type element is stricken by a print hammer, via an ink ribbon, against a sheet of print paper held on a platen. This type of printing apparatus has become in wide use because of its high capability of printing characters of various languages in a wide range of type styles by simply changing print wheels from one to another.

However, it is recognized in the art that such printing apparatus suffers printing errors which take place if and after a rotary shaft of the print wheel driving motor is rotated unexpectedly or unintendedly, for example, in the course of changing print wheels while the apparatus is on, i.e., while power is being applied to the apparatus. The possibility of those printing errors is high especially in a printing apparatus wherein its angular position detecting unit has no function to detect the rotating direction of the driving motor and consequently of the print wheel and thus the print wheel is always rotated in a fixed single direction before each printing action is taken.

SUMMARY OF THE INVENTION

Accordingly, it is an object of the present invention to provide a printing apparatus wherein there is no possibility of printing errors due to such unexpected rotation of a print wheel driving rotary shaft or a print wheel engaging therewith, that is not a result of the actuation of a print wheel driving motor.

Another object of the invention is to provide a printing apparatus having a print wheel wherein provisions are made for detecting an unexpected rotation of a print wheel driving motor or a rotary shaft driven thereby while the driving motor is not in operation in response to a signal from a control unit, and for resetting the print wheel to its home position, in the event of detecting such unexpected rotation, before the following printing action takes place.

A further object of the invention is to provide a printing apparatus of the preceding type, wherein the above detection of the unexpected rotation is performed before each printing action is taken.

A still further object of this invention is to provide a process for preventing printing errors, in a printing apparatus having a print wheel, due to such unexpected rotation of a print wheel driving rotary shaft, that is not a result of the actuation of a print wheel driving motor.

Still another object of the invention is to provide a process for preventing printing errors, in a printing apparatus having a print wheel, due to the said unexpected rotation, in which the unexpected rotation is detected while a print wheel driving motor is not in operation in response to a signal from a control unit, and in the event of detecting such unexpected rotation, the print wheel is reset to its home position before the following printing action takes place.

A printing apparatus constructed according to the present invention generally comprises:

a printing mechanism having a platen for supporting and feeding a sheet of print paper, carriage means, carriage driving means coupled to the carriage means for moving same along a print line defined on the print paper, and a print head assembly mounted on the carriage means and including a print wheel, a motor driving the print wheel and a print hammer, the print wheel having a plurality of type elements and being connected a rotary shaft of the print wheel driving motor;

a detecting unit generating angular position signals and a home position signal representative of angular positions and a home position of the print wheel, respectively; and a control unit including wheel rotation controlling means, responsive to printing signals representative of the type elements, for controlling the print wheel driving motor to operate to rotate the print wheel so that one of the type elements designated by any of the printing signals is brought to a fixed printing position of the print wheel, detecting means for detecting an unexpected rotation of the print wheel which is not a result of actuation of the print wheel driving motor, the detecting means generating a warning signal when the unexpected rotation is detected, and wheel resetting means for resetting, in response to the warning signal, the print wheel to the home position when a first one of the printing signals is received after generation of the warning signal, and before the print wheel is controlled, by the wheel rotation controlling means, to rotate for a normal printing action in response to the first printing signal.

In accordance with this invention, a process is provided for preventing printing errors in a printing apparatus having a printing mechanism including a print head assembly comprising a print wheel driving motor, and a print wheel having a plurality of type elements and connected to a rotary shaft of the print wheel driving motor, the printing apparatus further having a control unit, and a detecting unit generating angular position signals and a home position signal representative of angular positions and a home position of the print wheel, respectively; the process comprising the steps of:

checking to see if the rotary shaft is in rotation not through an actuation of the print wheel driving motor;

generating a warning signal if the rotary shaft is in rotation not through the actuation; and in the event the warning signal has been detected to be present, resetting the print wheel to the home position before the print wheel is controlled to rotate for a normal printing action in response to one of printing signals representative of the type elements.

According to the most important aspect of the present invention, the print wheel driving motor, print wheel driving rotary shaft or print wheel is checked for unexpected or unintended rotation, i.e., a rotation which is not a result of the actuation of the driving motor to bring a designated type element to the printing position at which the type element is striken by a print hammer. This checking which is made by monitoring the high-low level of angular position signals from the detecting unit, eliminates the chance for printing errors due to such unexpected rotation of the rotary shaft which most possibly occurs when the print wheel is changed to another.

BRIEF DESCRIPTION OF THE DRAWINGS

The above and other objects and advantages of the invention will become apparent from the following detailed description of the preferred embodiments, the appended claims, and the accompanying drawings in which:

DETAILED DESCRIPTION OF THE PREFERRED EMBODIMENTS

Referring now in particular to the accompanying drawings, a preferred embodiment of a printing apparatus according to the present invention will be described in detail, as a non-limiting example.

Figure 1:
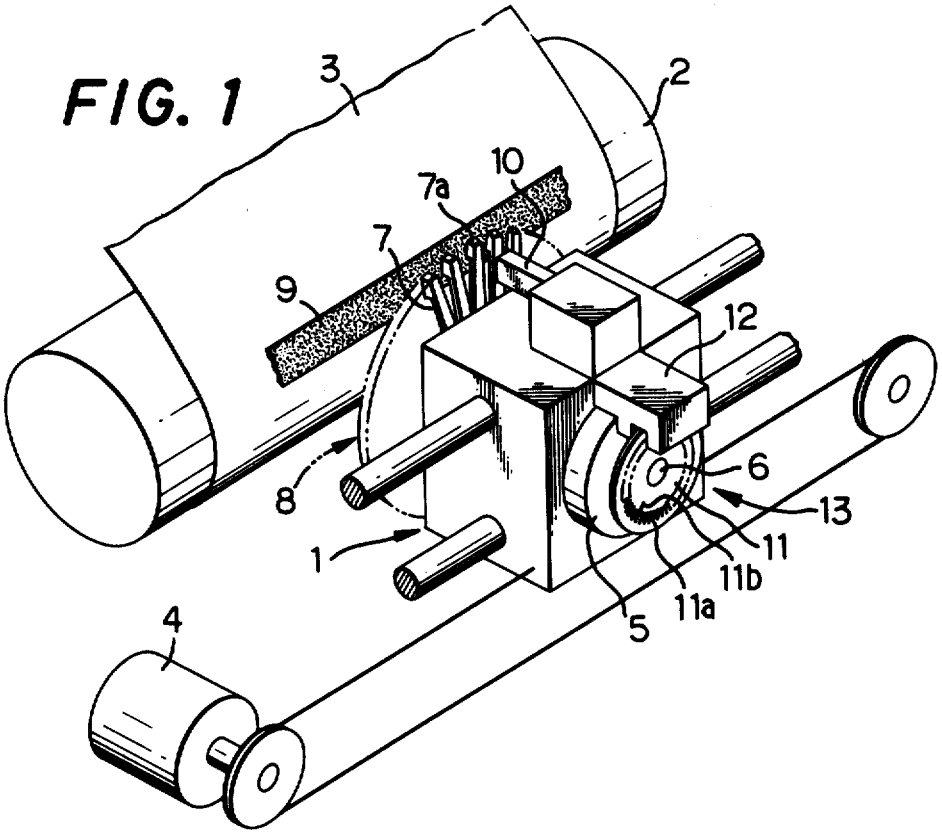
FIG. 1 is a view schematically illustrating substantially a mechanical part of a printing apparatus of the present invention.

A schematic illustration of the printing apparatus is presented in FIG. 1 wherein a carriage 1 is moved by a carriage driving motor 4 in a reciprocating manner along a print line defined on a sheet of print paper 3 retained on a platen 2. The carriage 1 carries: a print wheel driving motor 5 which is operable in a fixed unilateral direction; an interchangeable print wheel 8 which is removably or replaceably connected to one end of a rotary shaft 6 driven by the driving motor 5 and which has a multiplicity of type elements 7 circumferentially spaced on its periphery; a print hammer 10 which strikes a type element 7*a* currently located at a fixed printing position of the print wheel 8, against the print paper 3 via an ink ribbon 9; and a position detecting unit 13 which comprises a rotary disk 11 fixed to the other end of the rotary shaft 6, and further comprises an optical detector 12. The rotary disk 11 has a number of circumferentially spaced slits 11*a* and another slit 11*b* by which angular positions (rotation) and a home or reference position of the shaft 6, i.e., of the print wheel 8, are respectively detected by the detector 12. The print wheel driving motor 5, print wheel 8 and print hammer 10 combine to form an essential part of a print head assembly.

Figure 2:
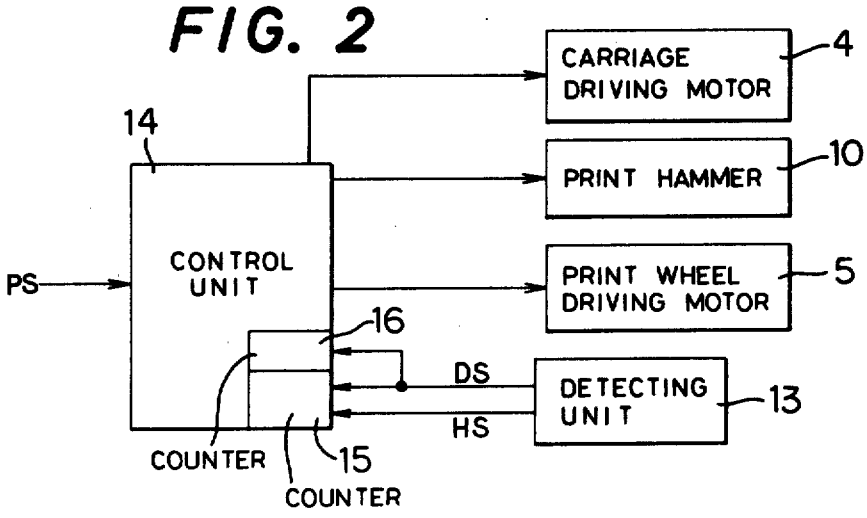
FIG. 2 is a block diagram showing the relationship between a control unit and other members of the printing apparatus.

There is provided a block diagram in FIG. 2 wherein a control unit 14 includes a first counter 15 which stores data representative of an angular distance Dx of the type element 7*a* currently located at the printing position as measured from the home position. As the print wheel driving motor 5 is rotated to drive the print wheel 8, the detecting unit 13 generates an angular position detecting signal DS each time the slit 11*a* is detected, and a home position signal HS when the slit 11*b* is detected. The signals DS and HS are fed to the counter 15 which increases to add one count each time it receives the signal DS. The counter 15 is reset when it receives the signal HS. The control unit 14 further comprises a second counter 16 which stores data representative of an angular distance Dy of a type element 7 designated by a later described printing signal PS, from its current position to the printing position. The detecting signals DS are also fed to this second counter 16, for the purposes described below, which moves down to reduce one count each time it receives the signal DS.

Figure 3:
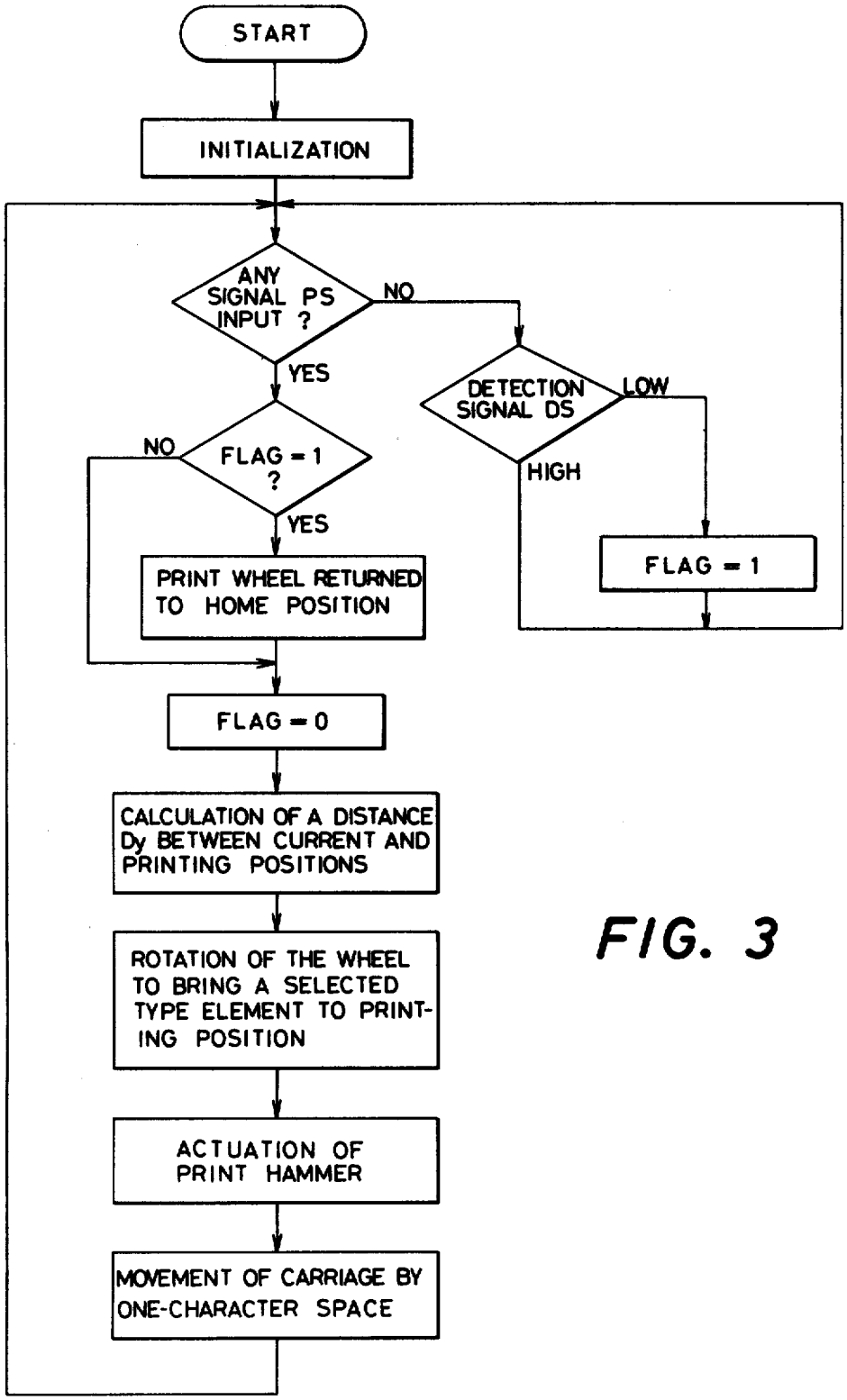
FIG. 3 is a flow diagram briefly showing a controlling process associated with a feature of the invention, in which a printing cycle of the apparatus is performed with selective steps for preventing possible printing errors.

Referring to a flow diagram in FIG. 3, a controlling sequence of operation in which a printing cycle of the apparatus is performed, will be described.

After the printing apparatus is turned on and initialized, the control unit 14 continuously checks to see whether or not it has received any of the above indicated printing signals PS which represent type element designating codes available. When the checking reveals that there is no printing signal PS received, the control unit 14 then checks to see, repeatedly at a very short time interval, whether the detecting signal DS is in the HIGH or LOW level state. Since, at this point of time, the print wheel driving motor 5 is not in operation in response to any printing signal PS and the rotary disk 11 is stopped with a given slit 11*a* being detected by the detector 12, the detecting unit 13 is generating a HIGH detecting signal DS. If the disk 11 is moved from one slit position to the next, for example, for some reasons at this time, not as a result of a rotation of the driving motor 5 in response to a drive signal from the control unit 14, the control unit 14 detects a LOW level state of the signal DS until the detecting unit 13 detects the next slit 11*a* or until the level of the signal DS becomes HIGH again. In this case where the signal DS is in the LOW level state, i.e., where the signal DS is absent, a flag alarm is given as "FLAG=1" within the control unit. The aspect of the HIGH-LOW checking of the signal DS and the resultant controlling steps are described below in more detail.

When the control unit 14 receives any one of the printing signal PS and the entry of this signal is confirmed while the flag alarm "FLAG=1" is not established (FLAG=0), the controlling proceeds to calculate the previously indicated angular distance Dy of a type element 7 designated by the received signal PS from its current position to the printing position. This calculation is made based on an angular distance Dz from the current position of the designated type element 7 to the home position and the previously indicated angular distance Dx. Then, the calculated angular distance Dy is stored in the second counter 16. In the next step, the control unit 14 directs the print wheel driving motor 5 to operate until the count of the second counter 16 is reduced to zero by the appropriate number of the signals DS which are presented to that counter 16 as the driving motor 5 is operated. In other words, the driving motor 5 and consequently the print wheel 8 are rotated until the type element 7 designated by the input printing signal PS is brought to the printing position. Then, the control unit 14 actuates the print hammer 10 to strike the designated type element now located at the printing position, and then actuates the carriage driving motor 4 to shift the carriage 1 by a unit distance (one-character space) equal to a specific feed pitch of the carriage. Now, the control goes back to the step of checking for entry of any printing signal PS.

To facilitate the description of another phase of the controlling process by the control unit, it is assumed that the flag alarm "FLAG=1" has been established before a printing signal PS is received by the control unit 14. As previously described, this flag alarm is established when the control unit 14 detects the LOW level state of the signal DS from the detecting unit 13 while there is no entry of the printing signal PS. In other words, the flag alarm is established when the rotary shaft 6 (driving motor 5, disk 11, or print wheel 8) is rotated, that is, the first counter 15 moves up to add the corresponding number of counts, while the driving motor 5 is not being actuated under the control of the control unit 14 in response to a printing signal PS. When the control unit 14 recognizes after confirming the entry of a signal PS that the flag alarm "FLAG=1" is established, the control then goes to the step wherein the print wheel driving motor 5 is operated until the home position signal HS is generated by the detecting unit 13 and the first counter 15 is reset by the home position signal HS. In this step, therefore, the driving motor 5 and the print wheel 8 are returned to their home position. After the counter 15 has been reset and the wheel 8 returned to the home position, the flag alarm "FLAG=1" is removed and the flag is initialized or zeroed as "FLAG=0". Then, the control unit 14 proceeds to the step of calculating the angular distance Dy and to the subsequent steps which are normally taken, as explained previously, to obtain a printing action of the print hammer 10 after the type element 7 designated by the signal PS has been brought to the printing position through the proper amount of rotation of the driving motor 5.

While, in the above embodiment, the driving motor 5 is returned to its home position only once, i.e., the single home position signal HS is detected, before a normal course of printing operation is performed after the detection of the flag alarm "FLAG=1", it will be appreciated to arrange the control unit so as to start the normal printing action only after the home position signal HS has been detected two or more times. Such arrangement is particularly effective in a printing apparatus having a print wheel loading and unloading mechanism as disclosed in the U.S. patent application, Ser. No. 275,013, filed on June 18, 1981, the disclosure of which is hereby incorporated by reference, which printing apparatus is characterized in that an interchangeable print wheel is, upon loading, put into engagement with a rotary shaft of a wheel driving motor at a predetermined position by rotating the rotary shaft two or more turns.

Although the control unit 14 used in the previous embodiment is arranged so that a single flag is required to establish the flag alarm, it is possible to arrange the control unit so that a plurality of flags are required, that is, the LOW level state of the signal DS be detected two or more times, before the flag alarm is established.

It will also be appreciated that the HIGH-LOW detection or checking of the signal DS is performed if the control unit 14 detects the non-actuation of the driving motor 5 rather than the non-entry of any printing signal PS.

It is clear that the previously indicated aspects of the present invention may also appear in a printing apparatus wherein a print wheel is rotatable bidirectionally and a detecting unit is capable of detecting the rotating direction of the print wheel.

It is to be understood that the form of the invention herein shown and described is to be taken only as non-limiting examples, and that various changes and modifications may be made to those skilled in the art without departing from the scope of the appended claims.

What is claimed is:

1. A printing apparatus comprising:

a printing mechanism having a platen for supporting and feeding a sheet of print paper, carriage means, carriage driving means coupled to said carriage means for moving same along a print line defined on the print paper, and a print head assembly mounted on the carriage means and including a print wheel, a motor driving said print wheel and a print hammer, said print wheel having a plurality of type elements and being connected a rotary shaft of said print wheel driving motor:

a detecting unit generating angular position signals and a home position signal representative of angular positions and a home position of said print wheel, respectively; and a control unit including wheel rotation controlling means, responsive to printing signals representative of said type elements, for controlling said print wheel driving motor to operate to rotate said print wheel so that one of said type elements designated by any of said printing signals is brought to a fixed printing position of said print wheel, detecting means for detecting an unexpected rotation of said print wheel which is not a result of actuation of said print wheel driving motor, said detecting means generating a warning signal when said unexpected rotation is detected, and wheel resetting means for resetting, in response to said warning signal, said print wheel to said home position when a first one of said printing signals is received after generation of said warning signal, and before said print wheel is controlled, by said wheel rotation controlling means, to rotate for a normal printing action in response to said first printing signal.

2. A printing apparatus as recited in claim 1, wherein said detecting unit comprises a rotary disk coupled to said rotary shaft and having a plurality of circumferentially spaced slits and another slit, said detecting unit further comprises an optical detector disposed on said carriage means so as to generate said angular position signals when any of said plurality of slits are detected and said home position signal when said another slit is detected.

3. A printing apparatus as recited in claim 1, wherein said detecting means detects a level of said angular position signals from said detecting unit while any of said printing signals is absent at said control unit.

4. A printing apparatus as recited in claim 3, wherein said warning signal is generated when said level is detected to be in a low state at least once.

5. A printing apparatus as recited in claim 1, wherein said unexpected rotation of said print wheel is detected by checking to see if any number of said angular position signals are generated from said detecting unit while any of said printing signals is absent at said control unit.

6. A printing apparatus as recited in claim 2, wherein said wheel rotation controlling means comprises a first and a second counter, said first counter counting said angular position signals and being reset by said home position signal, said second counter receiving said angular position signals.

7. A printing apparatus as recited in claim 6, wherein said first counter stores therein data representative of an angular distance of one of said type elements currently located at said printing position as measured from said home position, and said second counter stores therein data representative of an angular distance of one of said type elements designated by any of said printing signals from its current position to said home position.

8. A printing apparatus as recited in claim 1, wherein said wheel rotation controlling means, said detecting means and said wheel resetting means are formed by a microcomputer.

9. A process for preventing printing errors in a printing apparatus having a printing mechanism including a print head assembly comprising a print wheel driving motor, and a print wheel having a plurality of type elements and connected to a rotary shaft of said print wheel driving motor, said printing apparatus further having a control unit, and a detecting unit generating angular position signals and a home position signal representative of angular positions and a home position of said print wheel, respectively; said process comprising the steps of:

checking to see if said rotary shaft is in rotation not through an actuation of said print wheel driving motor;

generating a warning signal if said rotary shaft is in rotation not through said actuation; and in the event said warning signal has been detected to be present, resetting said print wheel to said home position before said print wheel is controlled to rotate for a normal printing action in response to one of printing signals representative of said type elements.

10. A process as recited in claim 9, wherein said checking to see if said rotary shaft is in rotation not through said actuation, comprises a step of checking to see if said print wheel driving motor is in operation under a control of said control unit, and further comprises a step of checking at least once, when said print wheel driving motor is not in operation under said control, to see if a level of said angular position signal is changed and wherein said warning signal is generated when said level is changed, and cleared after said print wheel is reset.

11. A process as recited in claim 10, wherein said checking to see if said print wheel driving motor is in operation under said control, is attained by checking to see if any one of said printing signals is present at said control unit.

12. A process as recited in claim 9, wherein said print wheel is reset to said home position when a first one of said printing signals is received by said control unit after generation of said warning signal.

13. A process as recited in claim 9, wherein said warning signal is checked for its presence each time any of said printing signals is received by said control unit.

14. A process as recited in claim 9, wherein said angular position signal whose level is checked, is generated by said detecting unit such that a plurality of slits angularly spaced on a rotary disk of said detecting unit are detected by an optical detector of same as said rotary disk is rotated with said print wheel driving motor.

* * * * *